US009751236B2

(12) United States Patent
Daul

(10) Patent No.: US 9,751,236 B2
(45) Date of Patent: Sep. 5, 2017

(54) HEIGHT ADJUSTABLE CONCRETE FORM ASSEMBLY

(71) Applicant: METAL FORMS CORPORATION, Milwaukee, WI (US)

(72) Inventor: Justin Daul, Wauwatosa, WI (US)

(73) Assignee: Metal Forms Corporation, Wilwaukee, WI (US)

( * ) Notice: Subject to any disclaimer, the term of this patent is extended or adjusted under 35 U.S.C. 154(b) by 201 days.

(21) Appl. No.: 14/595,855

(22) Filed: Jan. 13, 2015

(65) Prior Publication Data

US 2016/0199998 A1 Jul. 14, 2016

(51) Int. Cl.

| | |
|---|---|
| ***B28B 7/02*** | (2006.01) |
| ***E01C 19/48*** | (2006.01) |
| ***E04G 13/00*** | (2006.01) |
| ***E04G 17/12*** | (2006.01) |
| ***E04G 17/14*** | (2006.01) |

(52) U.S. Cl.

CPC ..... *B28B 7/02* (2013.01); *E01C 19/4886* (2013.01); *E04G 13/00* (2013.01); *E04G 17/12* (2013.01); *E04G 17/14* (2013.01)

(58) Field of Classification Search

CPC .. B28B 7/02; E04G 9/08; E04G 13/00; E04G 17/12; E04G 17/14

USPC ..... 264/31; 52/745.12; 425/171

See application file for complete search history.

(56) References Cited

U.S. PATENT DOCUMENTS

| | | | | | |
|---|---|---|---|---|---|
| 559,931 | A * | 5/1896 | Campbell | A21B 3/13 | 249/144 |
| 1,124,327 | A * | 1/1915 | Park | B28B 7/0014 | 249/14 |
| 1,374,864 | A * | 4/1921 | Raskin | E04G 13/023 | 249/157 |
| 1,644,584 | A * | 10/1927 | Heltzel | E01C 19/506 | 249/157 |
| 1,769,282 | A * | 7/1930 | Alin | E04G 9/08 | 249/157 |
| 1,939,007 | A * | 12/1933 | Heltzel | E01C 19/504 | 249/3 |

(Continued)

OTHER PUBLICATIONS

Barrier Rails: California Type 26 Brochure retrieved from Wadco Industries Inc. website on the Internet (http://www.wadcoindustries.com/cabarrier26.html), Jan. 13, 2015.

*Primary Examiner* — Michael Safavi
(74) *Attorney, Agent, or Firm* — Greer, Burns & Crain, Ltd.

(57) ABSTRACT

A form assembly is provided for forming a concrete structure during setting of the concrete. Included in the form assembly are a first barrier assembly having a first inner surface and a first outer surface; a second barrier assembly having a second inner surface, a second outer surface, an upper barrier, and a lower barrier. A channel is defined by the first and second inner surfaces of the first and second barrier assemblies for pouring the concrete into the channel. The second barrier assembly includes at least one height adjustment assembly being connected at one end to the upper barrier, and at an opposite end to the lower barrier such that the upper barrier vertically reciprocates along a vertical guide of the upper barrier relative to the lower barrier for adjusting an overall height of the form assembly using the at least one height adjustment assembly.

18 Claims, 10 Drawing Sheets

(56) References Cited

U.S. PATENT DOCUMENTS

| | | | | | |
|---|---|---|---|---|---|
| 1,948,931 | A * | 2/1934 | Mears | B28B 7/168 | 249/144 |
| 2,306,722 | A * | 12/1942 | Fox | E04G 13/06 | 249/14 |
| 3,063,122 | A * | 11/1962 | Katz | E04G 13/04 | 249/157 |
| 4,266,917 | A * | 5/1981 | Godbersen | E01C 19/4893 | 249/8 |
| 4,921,204 | A * | 5/1990 | Melfi | E01C 19/506 | 249/155 |
| 5,156,755 | A * | 10/1992 | Cass | E04G 15/063 | 249/152 |
| 5,219,473 | A * | 6/1993 | Sandwith | B28B 7/0014 | 249/155 |
| 6,866,239 | B2 | 3/2005 | Miller et al. | | |
| 7,806,647 | B2 | 10/2010 | Gomes et al. | | |
| 8,523,549 | B2 * | 9/2013 | Casanova | E04G 11/06 | 249/189 |

* cited by examiner

HEIGHT ADJUSTABLE CONCRETE FORM ASSEMBLY

FIELD OF THE INVENTION

The present invention generally relates to forms used for pouring concrete structure, and more specifically, to a height adjustable form assembly that may be used for pouring concrete structures of varying heights. Further, the present invention relates to a device for connecting adjustable forms used for pouring concrete structures.

BACKGROUND OF THE INVENTION

Concrete forms are often used for the purpose of pouring concrete structures, such as curbs, walls, sidewalks, or other structures of varying shapes. Typically, flexible or rigid sheet metal forms or wooden forms are used, and more recently plastic forms have been employed. In concrete construction, it is customary to erect a concrete barrier or bulkhead across the form to hold the poured concrete while the concrete becomes set or hardened, and produces an individual finished wall or slab section. When the hardening (or setting) of the concrete is completed, the barrier or bulkhead is dismantled and removed from its position, and the next pouring operation is performed alongside the hardened concrete section. Progressive erection of the wall or slab in this manner typically requires one or more barriers connected serially in a horizontal orientation, but the barriers are readily damaged and may become unusable during their removal and dismantling. Several types of concrete form assemblies are described in co-assigned U.S. Pat. No. 6,866,239, which is incorporated by reference.

Further, in certain cases, the concrete forms must create barrier walls having different heights to conform to the surrounding structures or the industry regulations for providing lateral bracing support for the concrete structures of varying elevation. Also, when a deck or ground surface upon which the concrete is poured is uneven, the form requires a height adjustment to account for the uneven condition of the deck or ground surface. Conventionally, an add-on riser assembly is placed on top of the form, and used to adjust an overall height of the concrete form. However, the add-on riser assembly generally provides only a predetermined height increase, and thus precise or gradual height adjustments are either impossible or very difficult to obtain. Moreover, replacing and adjusting the riser assembly delay a normal operational process, and each additional riser assembly having a different height must be purchased and stored separately, thereby increasing operational costs.

Therefore, there is a need for developing an improved concrete form assembly that facilitates an accurate height adjustment and an efficient concrete construction.

SUMMARY OF THE INVENTION

Advantages are achieved by the present concrete form assembly which includes an improved height adjustment and an economical concrete structure production. The present height adjustable concrete form assembly includes a top spacer assembly, a bottom spacer assembly, a front barrier assembly, and a rear barrier assembly, having at least one height adjustment assembly. As discussed in greater detail below, the present concrete form assembly provides an enhanced height adjustment function for concrete structure construction using the height adjustment assembly.

In operation, the use of the height adjustment assembly eliminates a need for attaching an additional riser assembly to the concrete form to achieve various required heights. Conventionally, a separate 4-inch riser assembly is attached on top of a 32-inch barrier assembly on each front and rear barrier wall to create a 36-inch tall barrier assembly. In the present invention, the height adjustment assembly can be used to alter an overall height of the form without adding or removing the riser assembly.

For example, at least one jackscrew mechanism of the height adjustment assembly is manually or mechanically turned clockwise or counterclockwise to decrease or increase the height of the form for leveling purposes. There is no need to attach or remove the riser assembly to and from the form, or purchase extra riser assemblies. Thus, the present adjustable form assembly provides an efficient means of height adjustment without causing additional delays and operating costs.

Another feature of the present invention is that the height adjustment assembly includes a built-in protective mechanism using a roll pin, which operates as a shear pin in the jackscrew mechanism. Over an operational life of the form, many adjustments are typically performed on the height adjustment assembly, thereby exhibiting signs of wear and tear.

For example, during the frequent use of leveling feature of the form, there may be increasing torque being applied on the jackscrew mechanism when two opposite-end jackscrews are not raised in unison. Instead of allowing excessive wear and tear on the jackscrew mechanism, the roll pin selectively shears when disproportionate travel or torque is applied on one of the jackscrews during operation. This protective mechanism protects the height adjustment assembly, and allows an effortless replacement of the jackscrew mechanism without having to replace the entire height adjustment assembly.

In one embodiment, a form assembly is provided for forming a concrete structure during setting of the concrete. The form assembly includes a first barrier assembly having a first inner surface and a first outer surface. A second barrier assembly has a second inner surface, a second outer surface, an upper barrier, and a lower barrier. A channel is defined by the first and second inner surfaces of the first and second barrier assemblies to allow concrete to be poured into the channel. A vertical guide is disposed in one of the upper barrier or lower barrier configured for slidingly receiving a portion of the other of the upper barrier and the lower barrier. The second barrier assembly includes at least one height adjustment assembly being connected at one end to the upper barrier, and at an opposite end to the lower barrier such that the guide of the upper barrier vertically reciprocates relative to the lower barrier to adjust an overall height of the form assembly using the at least one height adjustment assembly.

In another embodiment, a height adjustment assembly used in a form assembly is provided, having a lower barrier with a bottom plate, and an upper barrier, and constructed for forming a concrete structure during setting of the concrete. The height adjustment assembly includes a lower member being attached at one end of the bottom plate of the lower barrier of the form assembly. A jackscrew mechanism is provided for the height adjustment assembly, and includes a threaded connector disposed at an upper end of the lower member; a removable threaded rod forming an end of the jackscrew mechanism, the end of the jackscrew mechanism being connected to the threaded connector using complementary helically threaded portions to threadably telescope the form assembly for height adjustment; a turn knob mechanically connected to the upper barrier of the form assembly, the turn knob operably connected to the threaded rod; and a coupler collar having a central opening dimensioned at one end to slidingly receive the turn knob, and at an opposite end to slidingly receive the threaded rod. The upper barrier of the form assembly is vertically movable relative to the lower barrier to adjust an overall height or slope of the form assembly by rotating the turn knob.

In yet another embodiment, a barrier assembly used in a form assembly is provided for forming a concrete structure during setting of the concrete. The barrier assembly includes an upper barrier having at least one upper side plate attached to an outer surface of the upper barrier. A lower barrier has at least one lower side plate attached to an outer surface of the lower barrier. A height adjustment assembly is connected at one end to the upper barrier, and at an opposite end to the lower barrier such that the height adjustment assembly increases or decreases an overall height or slope of the upper barrier relative to the lower barrier. A plurality of bores are provided in corresponding upper and lower side plates to provide a serial attachment of two adjacent form assemblies using fasteners through the plurality of bores.

The foregoing and other aspects and features of the invention will become apparent to those of reasonable skill in the art from the following detailed description, as considered in conjunction with the accompanying drawings.

DETAILED DESCRIPTION OF THE PREFERRED EMBODIMENTS

Figure 1:
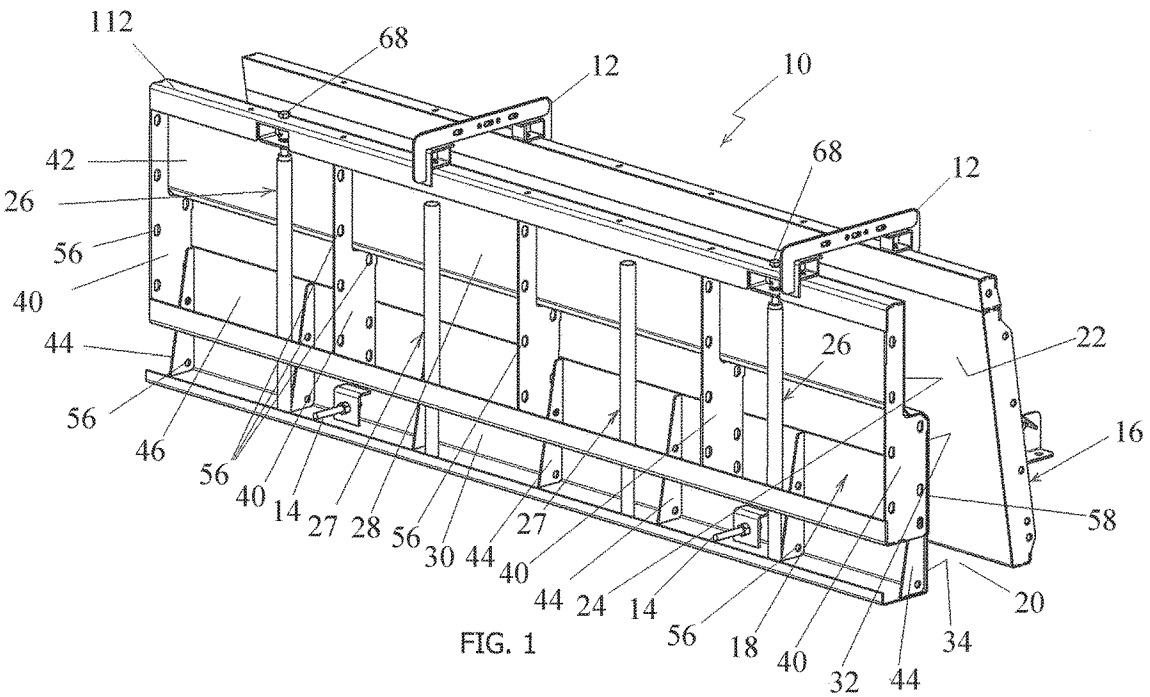
FIG. 1 is a top perspective view of the present concrete form assembly, featuring a top spacer assembly, a bottom spacer assembly, a front barrier assembly, and a rear barrier assembly, having two height adjustment assemblies.
Figure 2:
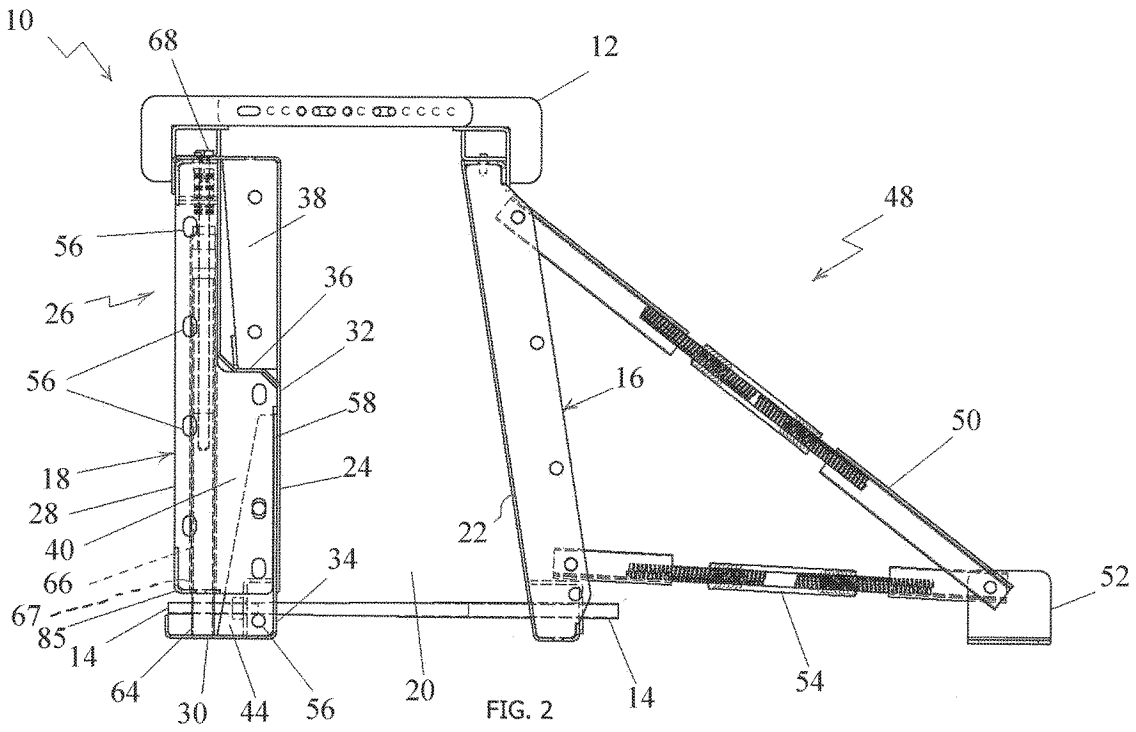
FIG. 2 is a side view of the present concrete form assembly shown in FIG. 1.
Figure 3:
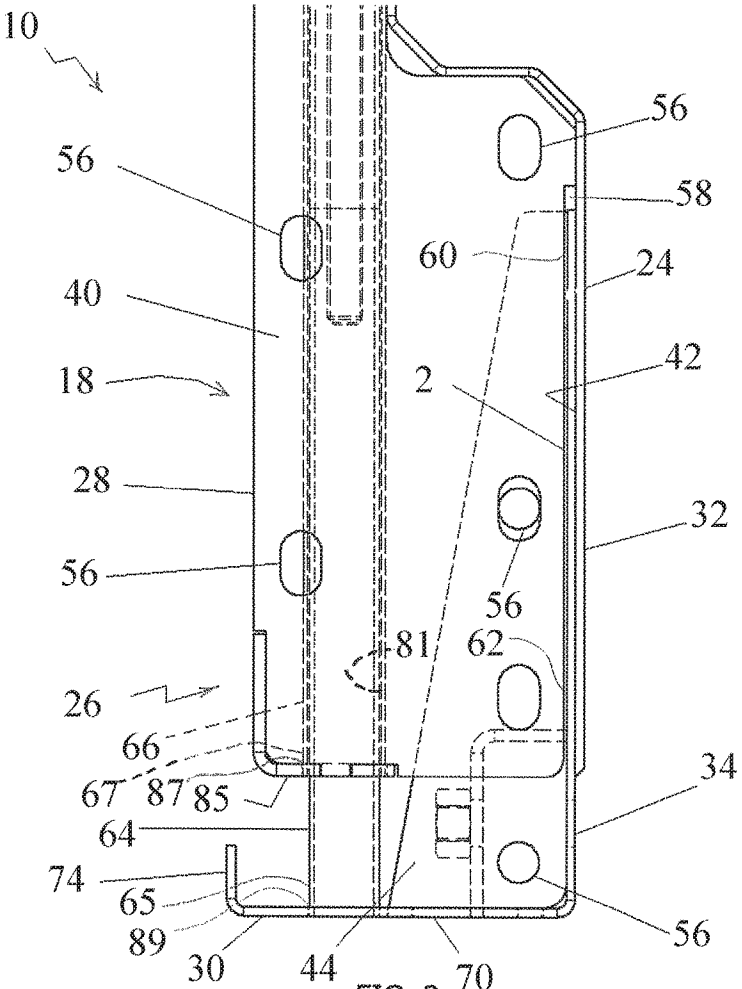
FIG. 3 is a fragmentary enlarged side view of the rear barrier assembly shown in FIG. 1.

Referring now to FIGS. 1-3, the present concrete form assembly is generally designated 10, and is designed to provide an efficient way to adjust an overall height of the form assembly, and also to perform enhanced concrete constructions without incurring substantial operational delays and costs. Included in the present form assembly 10 are a top spacer assembly 12, a bottom spacer assembly 14, a first or front barrier assembly, generally designated 16, and a second or rear barrier assembly, generally designated 18. When pouring concrete into a channel 20 defined by inner surfaces 22, 24 of the first and second barrier assemblies 16, 18, the top and bottom spacer assemblies 12, 14 hold the form assembly 10 in its original shape such that the poured concrete can be cured and hardened without disfigurement or interruption.

Each second or rear barrier assembly 18 includes at least one height adjustment assembly, generally designated 26, an upper barrier 28, and a lower barrier 30. The height adjustment assembly 26 is connected at one end to the upper barrier 28, and at an opposite end to the lower barrier 30 such that a telescoping operation of the height adjustment assembly increases or decreases the overall height of the form assembly 10. The telescoping operation of the height adjustment assembly 26 is described in greater detail below in paragraphs relating to FIGS. 3-5.

An interior space of the channel 20 is further defined by an upper interior wall 32 of the upper barrier 28, a lower interior wall 34 of the lower barrier 30, and the inner surface 22 of the first barrier assembly 16. The upper interior wall 32 can have a predetermined profile or contour, as desired, to form a particular shape. For example, as shown in FIGS. 1 and 2, a stepped ledge 36 may be formed on the upper interior wall 32 for receiving additional concrete. When a planar or straight surface is desired on the upper interior wall 32, an optional offset adapter assembly 38 (FIG. 2) is releasably attached to the upper interior wall for providing the planar surface.

As shown in FIG. 1, at least one upper side plate 40 is disposed at each opposite end of the upper interior wall 32. More specifically, each upper side plate 40 is attached to an outer surface 42 of the upper interior wall 32 transverse to a plane defined by the upper interior wall for providing lateral bracing support for the concrete poured into the channel 20. Optionally, one or more upper side plates 40 are disposed between opposite ends of the upper interior wall 32. In a similar configuration, at least one lower side plate 44 is disposed at each opposite end of the lower interior wall 34. As is the case with the upper side plate 40, the lower side plate 44 is attached transversely to an outer surface 46 of the lower interior wall 34 for supporting the concrete in the channel 20.

In a preferred embodiment, a form aligner assembly, generally designated 48 (FIG. 2) having at least one adjustable arm is also provided for supporting the first barrier assembly 16. For example, a first adjustable arm 50 is attached at one end to an upper portion of the first barrier assembly 16, and at an opposite end to a base support 52. Similarly, a second adjustable arm 54 is attached at one end to a lower portion of the first barrier assembly 16, and at an opposite end to the base support 52. The form aligner assembly 48 operates as an anchoring device such that the form assembly 10 is rigidly affixed in ground footings or other bases upon which the form assembly is used.

Attachment of various parts of the form assembly 10 is achieved by using conventional fasteners, adhesives, welding, or other suitable methods known in the art. As an example, it is contemplated that a plurality of bores 56 are provided, preferably, near a peripheral edge of each upper and lower side plates 40, 44 for providing a serial attachment of two adjacent form assemblies 10 using any conventional connection method known in the art (e.g., bolts and nuts). Some or all of these bores 56 may be in the form of vertical slots to accommodate slight vertical displacements between two adjoining form assemblies 10.

A vertical or longitudinal slot or guide 58 (FIG. 3) is defined by an indent portion or stepped edge 60 disposed near a lower inner corner edge 62 of the upper side plate 40, and the outer surface 42 of the upper interior wall 32. The vertical slot or guide 58 is provided, preferably, in the upper barrier 28 for slidingly receiving an edge of the lower interior wall 34 of the lower barrier 30 such that the upper barrier vertically reciprocates in a guided manner along the vertical slot relative to the lower barrier for adjusting the height of the form assembly 10 under the action of the height adjustment assembly 26. However, it is also contemplated that the vertical slot or guide 58 can be provided in the lower barrier 30 for slidingly receiving an edge of the upper interior wall 32 or the upper side plates 40. Other suitable configurations are also contemplated to suit different applications.

Figure 5:
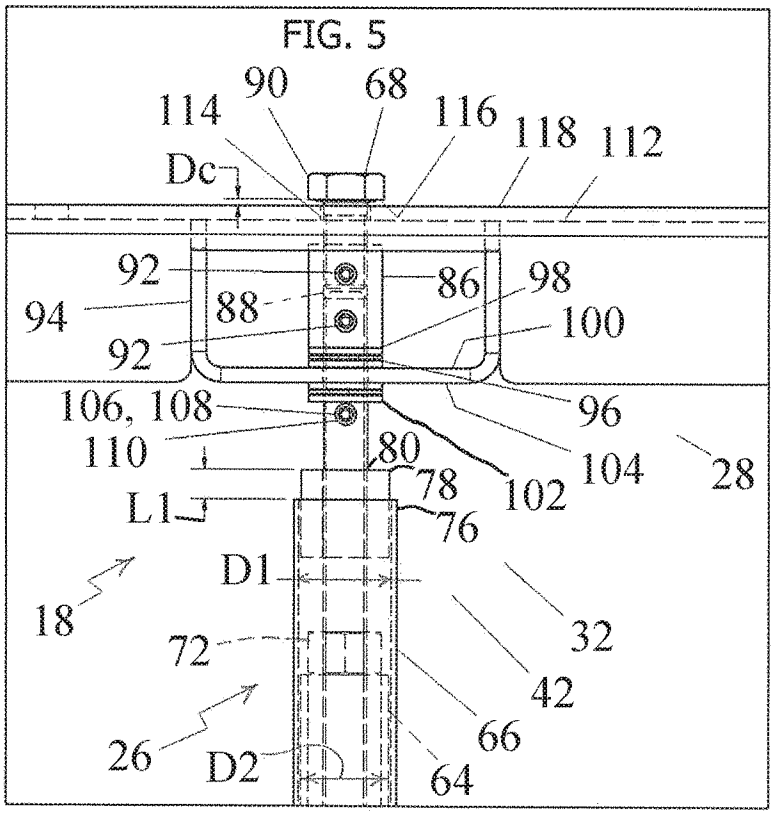
FIG. 5 is a fragmentary enlarged side view of the height adjustment assembly shown in FIG. 4.
Figure 4:
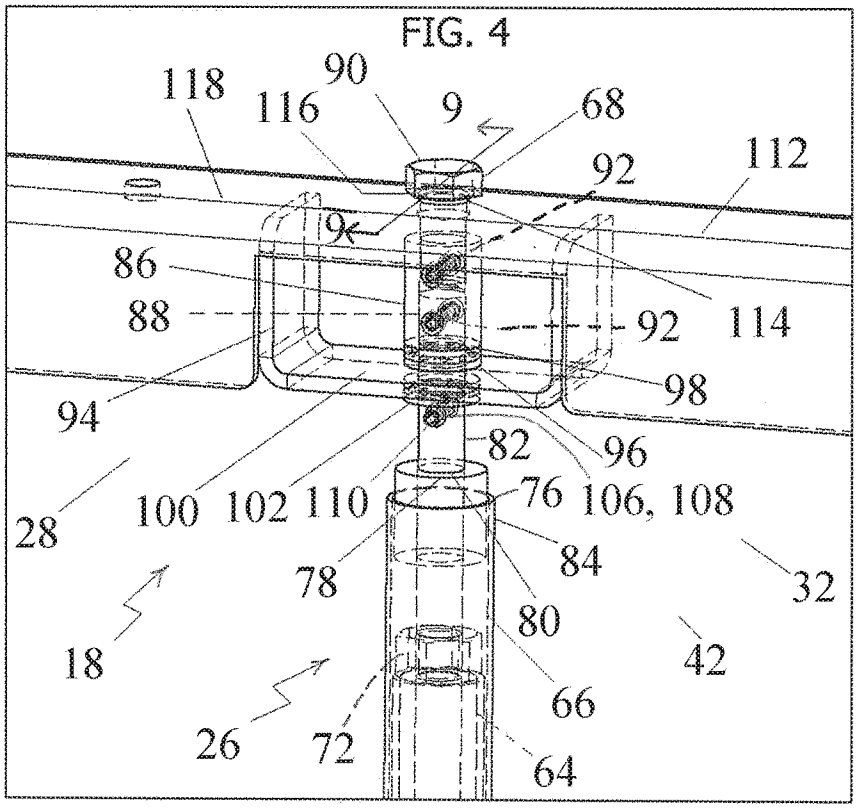
FIG. 4 is a fragmentary enlarged perspective view of the height adjustment assembly shown in FIG. 1, featuring a jackscrew mechanism and a protective mechanism.

Referring now to FIGS. 3-5, it is preferred that the height adjustment assembly 26 includes a lower member 64, an upper member 66, and a jackscrew mechanism 68. Preferably, both lower and upper members 64, 66 include an elongated cylindrical body having a central opening configured and dimensioned for facilitating a telescoping operation of the lower and upper members, but other suitable geometric shapes, such as triangular or quadrilateral shapes, are contemplated to suit different applications.

The lower member 64 is attached at one end to a bottom or base plate 70 of the lower barrier 30 (FIG. 3), and at an opposite end to a threaded connector or nut 72 sized to slidingly fit inside of the upper member 66 (FIGS. 4 and 5). In this configuration, the upper member 66 is used as a guide sleeve for the lower member 64, and shields or protects the threaded connector 72 from debris and concrete to keep the area clean during operation. Alternative vertical guides could be provided such as projections riding in vertical slots, grooves, channels, etc., or between vertical walls. It is also contemplated that locations of the slots and the projections can be on either the lower or upper member 64, 66 depending on the application.

A flange or lip 74 (FIG. 3) extends transversely from an outer edge of the bottom or base plate 70, and thus a combination of the lower interior wall 34, the bottom plate 70, and the flange 74 forms a "J"-shaped plate. It is preferred that the combination of the lower interior wall 34, the bottom plate 70, and the flange 74 is integrally formed, but other suitable connections are also contemplated to suit the application.

Referring now to FIGS. 3-5 and 9, an upper end 76 of the upper member 66 is attached to a spacer sleeve 78 having a central opening 80 configured and dimensioned for slidingly receiving a threaded rod or shaft 82, and an outer surface 84 of the upper member 66 is attached to the outer surface 42 of the upper interior wall 32 in a direction of the longitudinal axis of the upper member. Attachment of the upper member 66 to the upper interior wall 32 is achieved by using conventional fasteners, adhesives, welding, or other suitable methods known in the art.

As shown in FIG. 3, it is preferred that a lower end 67 of the upper member 66 is attached to a bottom plate 85 of the upper barrier 28 to be anchored in place. More specifically, the bottom plate 85 has an opening or cavity 87 to receive the lower end 67 of the upper member 66 such that the upper member is positioned and secured to the bottom plate 85 by welding, adhesive, or other suitable methods known in the art. Similarly, it is preferred that a lower end 65 of the lower member 64 is attached to the bottom or base plate 70 of the lower barrier 30. More specifically, the base plate 70 has an opening or cavity 89 to receive the lower end 65 of the lower member 64 such that the lower member is positioned and secured to the base plate 70 by welding, adhesive, or other suitable methods known in the art. Although the "L"-shaped bottom plate 85 is shown herein, other suitable shapes are contemplated to suit the application.

Returning to FIGS. 3-5 and 9, the upper member 66 has a central opening 81 (FIG. 3) configured for slidingly receiving each one of the lower members 64. It is preferred that an inner diameter D1 of the upper member 66 is greater than an outer diameter D2 of the lower member 64 (FIG. 5), such that the upper member telescopes in a direction of a longitudinal axis of the lower member for facilitating the height adjustment of the form assembly 10. As such, the central opening 81 of the upper member 66 may be sized to receive the lower member 64 in a telescoping relationship.

In a preferred embodiment, the spacer sleeve 78 is partially inserted into the upper end 76 of the upper member 66, such that a predetermined length L1 of the spacer sleeve is exposed and extended out of the upper end of the upper member. An exemplary length L1 of the exposed portion of the space sleeve 78 is approximately 0.5 inch. The exposed portion allows the space sleeve 78 to be secured to the upper member 66, such as by welding.

The threaded rod 82 is removably connected at one end to the jackscrew mechanism 68, and at an opposite end is threadably connected to the threaded nut 72 captured on the upper end of the lower member 64, using complementary helically threaded portions for threadably driving telescoping of the upper member 66 relative to the lower member 64 for height adjustment. More specifically, the jackscrew mechanism 68 of the height adjustment assembly 26 includes a coupler collar 86 having a central opening 88 configured and dimensioned for at one end slidingly receiving a turn knob or bolt 90, and at an opposite end slidingly receiving the threaded rod 82.

Attachment between the turn knob 90 and the coupler collar 86 is achieved by using a fastener or screw 92, and similarly the coupler collar 86 and the threaded rod 82 are connected by using the fastener. A view box 94 is provided for at least partially enclosing the jackscrew mechanism 68 for allowing easy access to the coupler collar 86, the turn knob 90, the threaded rod 82, and the fasteners 92. The view box 94 provides an ample space and clear view for cleaning and exchanging the exposed parts of the jackscrew mechanism 68 as desired. Although a "U"-shaped enclosure is shown for the box 94, other suitable shapes are contemplated to suit the application.

In a preferred embodiment, a first thrust bearing 96 is disposed between a lower end 98 of the coupler collar 86 and an inner surface 100 of the view box 94 for supporting an axial load of the upper barrier 28, and preventing excessive wear and tear of the associated parts of the jackscrew mechanism 68. Also, a second thrust bearing 102 is disposed between an outer surface 104 of the view box 94 and a protective mechanism 106. It is contemplated that each thrust bearing 96, 102 can be a three-piece bearing having a plastic inner ring sandwiched by two metal outer rings, but other suitable types of bearings are also contemplated as known in the art.

Figure 9:
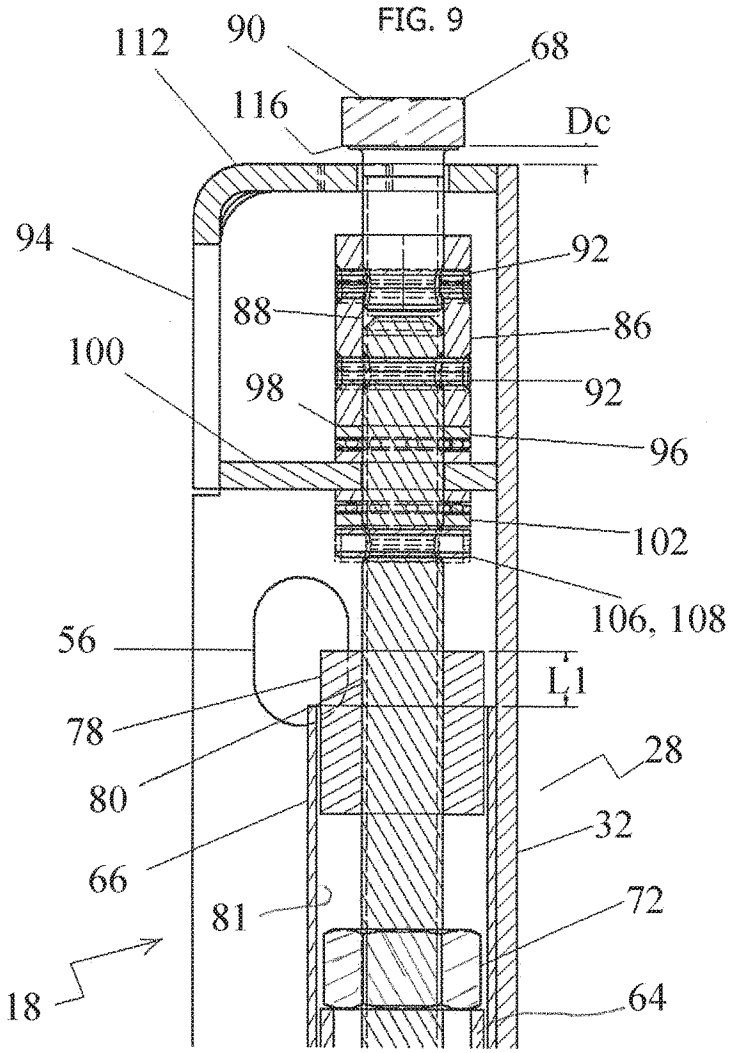
FIG. 9 is a partial cross-sectional view of the height adjustment assembly taken along the line 9-9 of FIG. 4 and in the direction generally indicated.

More specifically, as illustrated in FIG. 9, it is preferred that the protective mechanism 106 includes a roll pin 108, which operates as a shear pin in the jackscrew mechanism 68. A bore 110 is provided near an upper end of the threaded rod 82 for threadably or slidingly receiving the roll pin 108. Since the second thrust bearing 102 bears the most load of the upper barrier 28, the roll pin 108 is preferably disposed directly below the second thrust bearing. However, any of the fasteners 92 can be additionally or alternatively replaced with the roll pin 108 to suit different applications, and conversely, the roll pin 108 can be replaced with the fasteners. In use, when disproportionate travel, torque, or axial load is applied on the jackscrew mechanism 68, the roll pin 108 selectively shears or breaks to protect the jackscrew mechanism. Another optional thrust bearing or washer may be positioned between a top plate 112 of the upper barrier 28 and the coupler collar 86 for an additional axial support.

The top plate 112 of the upper barrier 28 has a bore 114 configured for slidingly receiving the turn knob 90. The turn knob 90 is inserted into the bore 114, and removably connected to the threaded rod 82. Specifically, the threaded rod 82 is connected at one end to the turn knob 90 using the fastener 92, and at an opposite end is threadably connected to the threaded nut 72 of the lower member 64, such that the upper member 66 telescopes relative to the lower member in a direction of the longitudinal axis of the lower member when the turn knob is rotated clockwise or counterclockwise.

A clearance having a predetermined distance $D_C$ is created between a lower head edge 116 of the turn knob 90 and an outer surface 118 of the top plate 112. This clearance helps reducing friction wear and tear of the turn knob 90 during rotational movement. For vertical height adjustment of the form assembly 10, the turn knob 90 is manually or mechanically turned clockwise or counterclockwise to decrease or increase the height of the upper barrier 28, and also for leveling purposes by individually adjusting one or both turn knobs.

Figure 6:
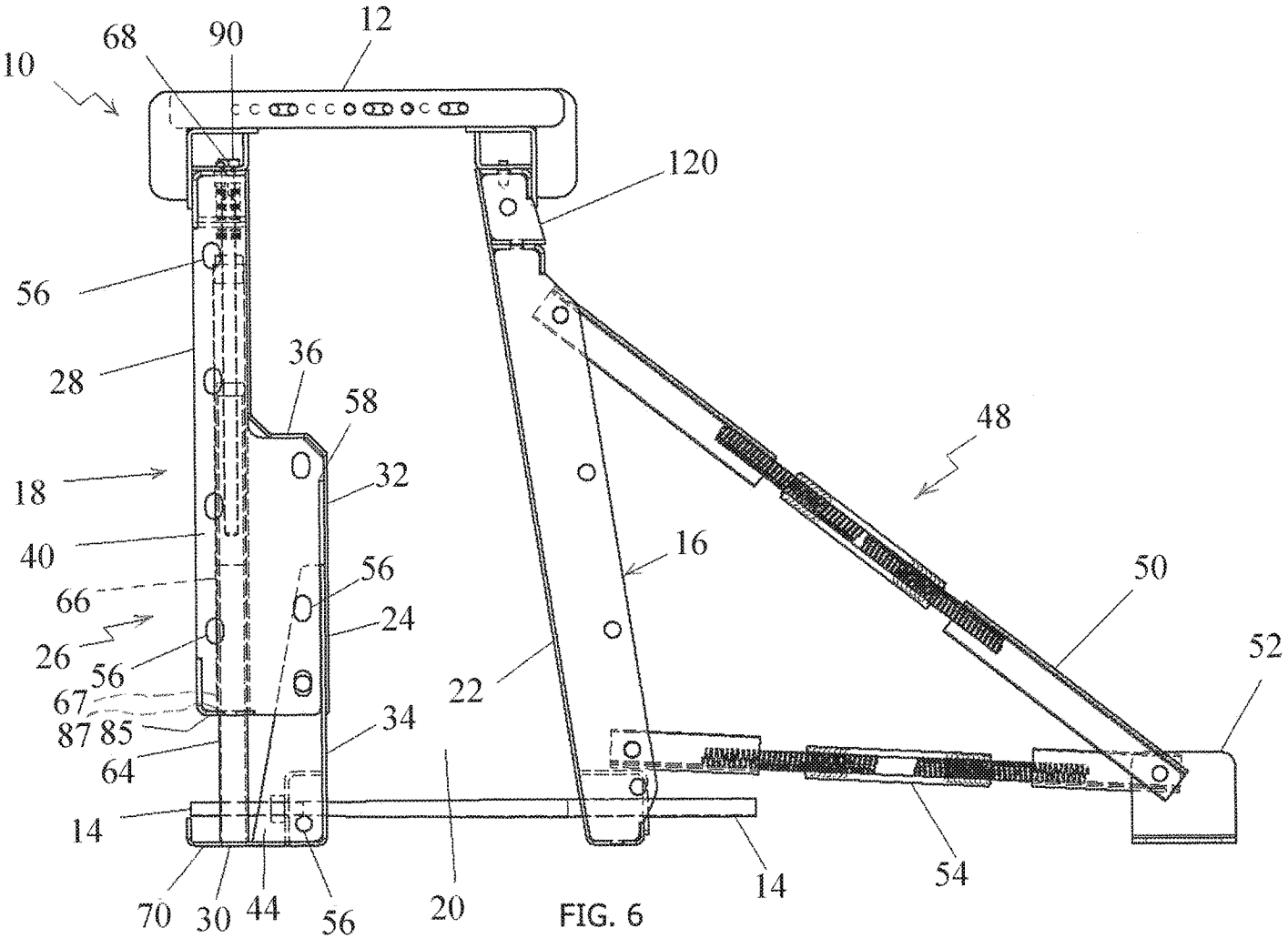
FIG. 6 is a side view of the present concrete form assembly shown in FIG. 1, featuring the use of a riser assembly in conjunction with the height adjustment assembly.

Referring now to FIG. 6, when the turn knob 90 is adjusted to increase the overall height of the second barrier assembly 18, the upper member 66 attached to the upper barrier 28 is vertically raised along the vertical slot 58 under the action of the height adjustment assembly 26. As for the first barrier assembly 16, however, a riser assembly 120 is removably attached on top of the first barrier assembly to compensate the height increase of the second barrier assembly 18. As discussed above, there is no need to attach or remove the riser assembly 120 to and from the second barrier assembly 18, or purchase extra riser assemblies of different heights when using the present height adjustment assembly 26. Thus, the height adjustment assembly 26 provides an efficient means of height adjustment and slope accommodation without causing additional delays or added operating costs.

Figure 7A:
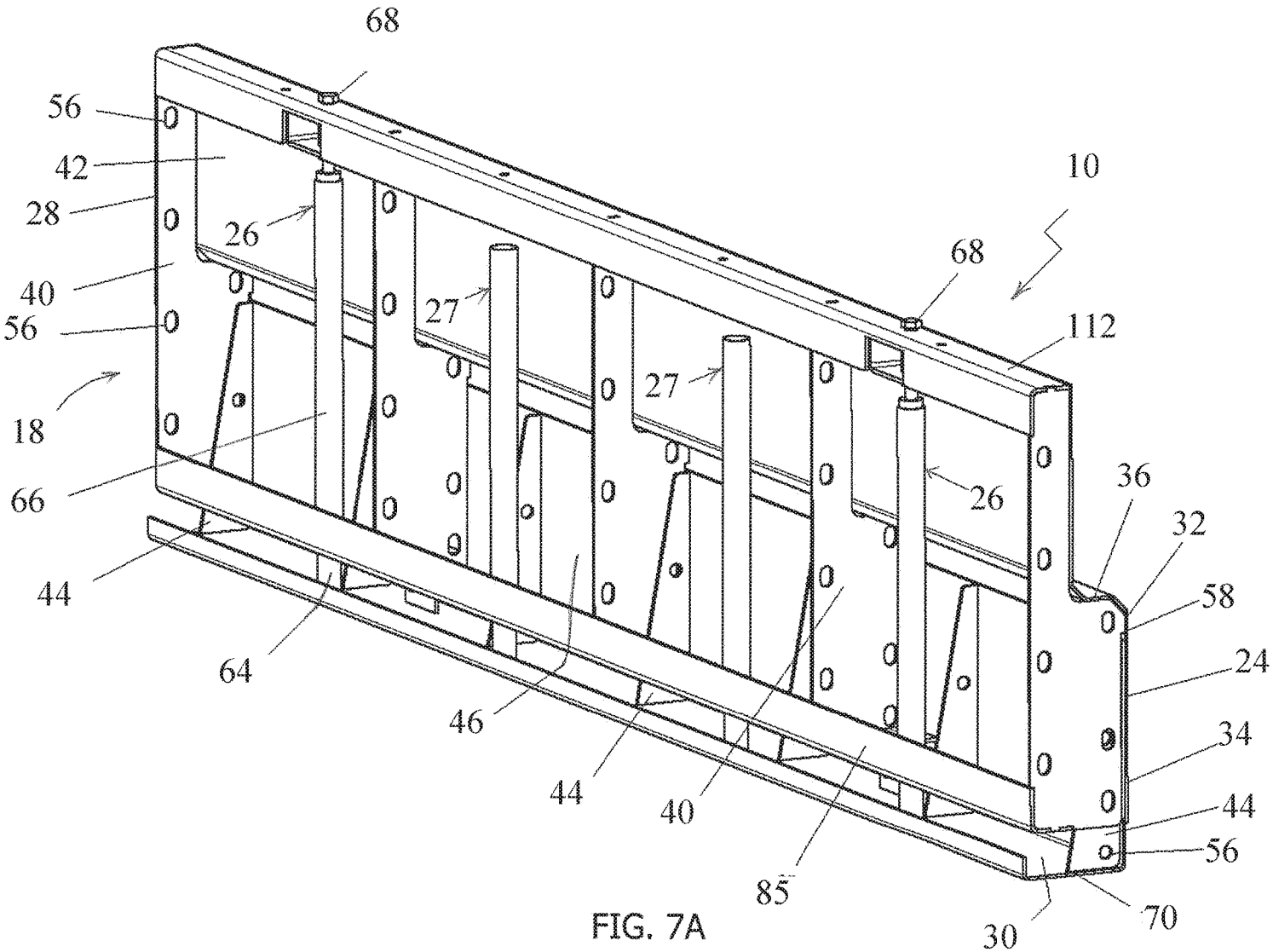
FIGS. 7A-7C are perspective views illustrating the rear barrier assembly shown in FIG. 1 being height-adjusted to 32-inch, 36-inch, and 42-inch tall, respectively.
Figure 7B:
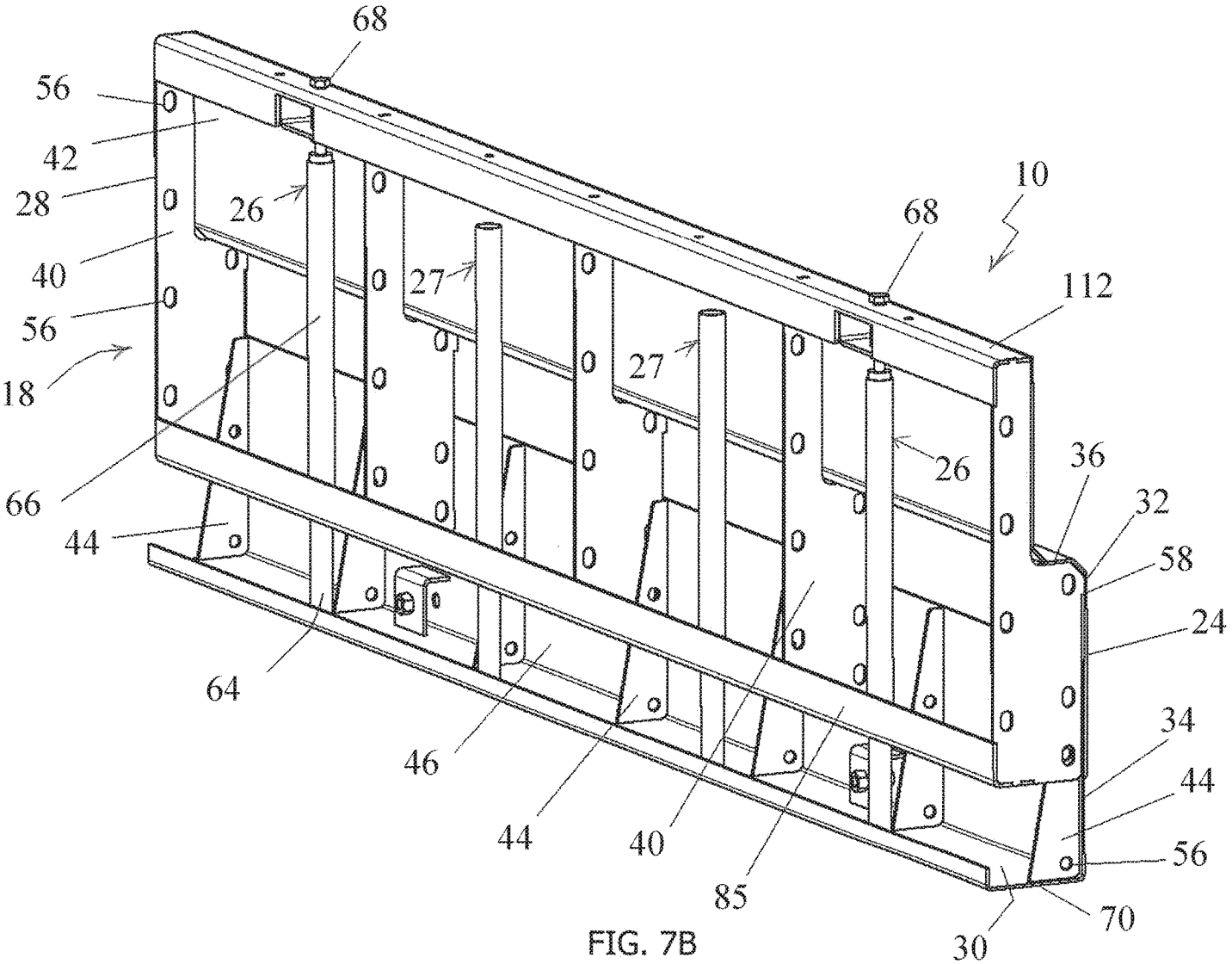
Figure 7C:
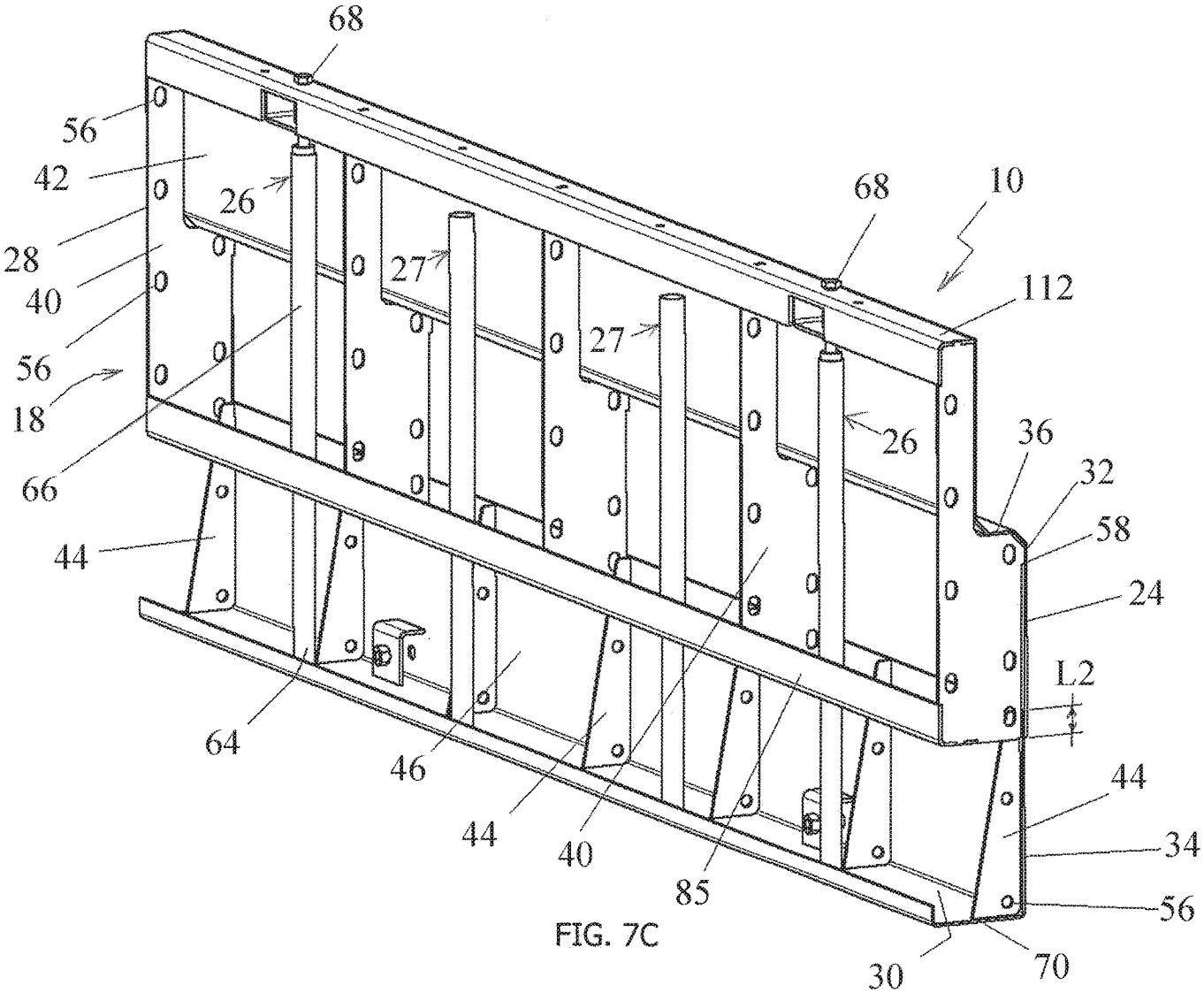

Referring now to FIGS. 7A-7C, the second barrier assembly 18 readily transitions between the 32-inch, 36-inch, and 42-inch height settings using the height adjustment assembly 26. It is contemplated that one or more upper members 66 of the height adjustment assembly 26 are attached to the outer surface 42 of the upper interior wall 32 of the upper barrier 28 without the jackscrew mechanism 68 for providing aligning and guiding of the lower members 64. For example, guide assemblies 27 having the upper and lower members 66, 64 are positioned near the middle of the upper barrier 28 without the jackscrew mechanism 68, and yet are received on the lower members 64. It is preferred that at least two height adjustment assemblies 26 positioned near opposite ends of the upper barrier 28 have the corresponding jackscrew mechanisms 68.

Figure 8C:
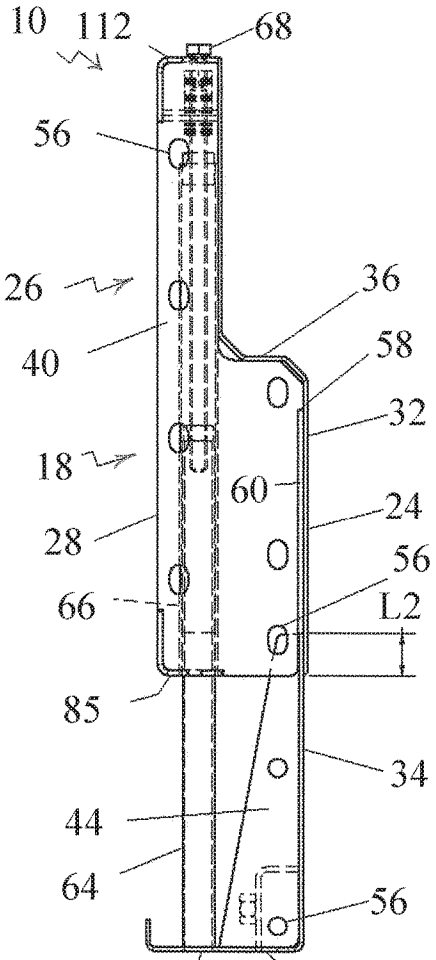
FIGS. 8A-8C are respective side views of the rear barrier assembly shown in FIGS. 7A-7C.
Figure 8B:
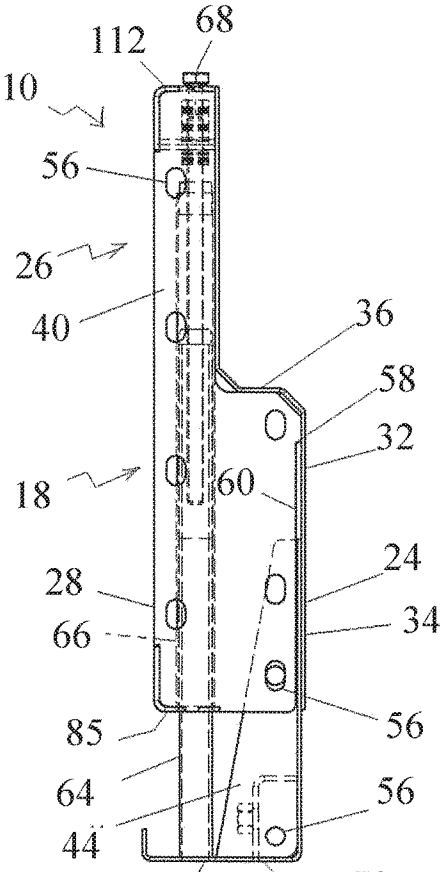
Figure 8A:
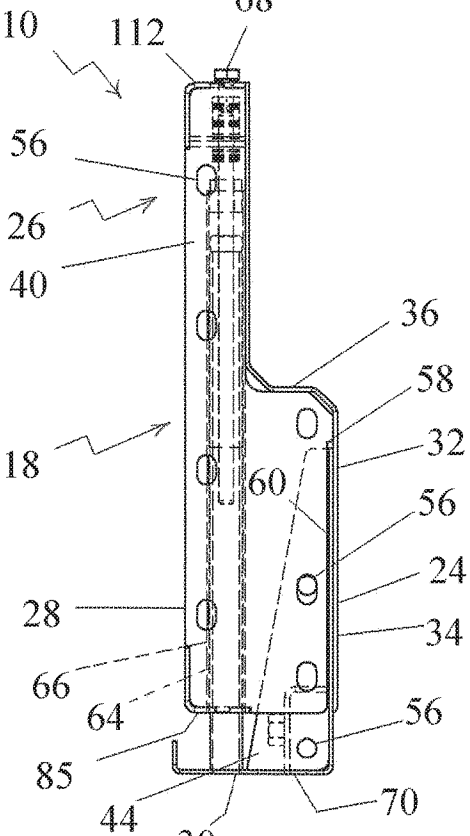

FIGS. 8A-8C illustrate respective side views of the second barrier assembly 18 shown in FIGS. 7A-7C. It is preferred that a predetermined minimum length L2 (FIGS. 7C and 8C) of the lower interior wall 34 of the lower barrier 30 remains engaged in the vertical slot 58 of the upper barrier 28 for sustaining stability of the form assembly 10. An exemplary minimum engaged length L2 of the lower interior wall 32 is approximately 2 inches.

While at least one exemplary embodiment of the present invention has been shown and described, it should be understood that modifications, substitutions and alternatives may be apparent to one of ordinary skill in the art and can be made without departing from the scope of the invention described herein. This application is intended to cover any adaptations or variations of the specific embodiments discussed herein. In addition, in this application, the terms "comprise" or "comprising" do not exclude other elements or steps, and the terms "a" or "one" do not exclude a plural number. Furthermore, characteristics or steps which have been described with reference to one of the above exemplary embodiments may also be used in combination with other characteristics or steps of other exemplary embodiments described above.

What is claimed is:

1. A height adjustment assembly used in a form assembly having a lower barrier with a bottom plate, and an upper barrier, constructed for forming a concrete structure during setting of the concrete, the height adjustment assembly comprising:

a lower member being attached at one end of the bottom plate of the lower barrier of the form assembly; and a jackscrew mechanism comprising:

a threaded connector disposed at an upper end of the lower member;

a removable threaded rod forming an end of the jackscrew mechanism, the end of the jackscrew mechanism being connected to the threaded connector using complementary helically threaded portions to threadably telescope the form assembly for height adjustment;

a turn knob mechanically connected to the upper barrier of the form assembly, the turn knob operably connected to the threaded rod; and a coupler collar having a central opening dimensioned at one end to slidingly receive the turn knob, and at an opposite end to slidingly receive the threaded rod, wherein the upper barrier of the form assembly is vertically movable relative to the lower barrier to adjust an overall height or slope of the form assembly by rotating the turn knob.

2. A form assembly for forming a concrete structure during setting of the concrete, the form assembly comprising:

a first barrier assembly having a first inner surface and a first outer surface;

a second barrier assembly having a second inner surface, a second outer surface, an upper barrier, and a lower barrier;

a channel defined at least by the first and second inner surfaces of the first and second barrier assemblies to allow concrete to be poured into the channel; and a vertical guide disposed in one of the upper barrier or lower barrier configured for slidingly receiving a portion of the other of the upper barrier and the lower barrier, wherein the second barrier assembly includes at least one height adjustment assembly being connected at one end to the upper barrier, and at an opposite end to the lower barrier such that the guide of the upper barrier vertically reciprocates relative to the lower barrier to adjust an overall height of the form assembly using the at least one height adjustment assembly, wherein the portion of the lower barrier includes an edge of a lower interior wall of the lower barrier of the second barrier assembly, and, wherein at least one lower side plate is attached transversely to an outer surface of the lower interior wall to support the concrete in the channel.

3. A form assembly for forming a concrete structure during setting of the concrete, the form assembly comprising:

a first barrier assembly having a first inner surface and a first outer surface;

a second barrier assembly having a second inner surface, a second outer surface, an upper barrier, and a lower barrier;

a channel defined at least by the first and second inner surfaces of the first and second barrier assemblies to allow concrete to be poured into the channel; and a vertical guide disposed in one of the upper barrier or lower barrier configured for slidingly receiving a portion of the other of the upper barrier and the lower barrier, wherein the second barrier assembly includes at least one height adjustment assembly being connected at one end to the upper barrier, and at an opposite end to the lower barrier such that the guide of the upper barrier vertically reciprocates relative to the lower barrier to adjust an overall height of the form assembly using the at least one height adjustment assembly, wherein the portion of the lower barrier includes an edge of a lower interior wall of the lower barrier of the second barrier assembly, and, wherein at least one upper side plate is attached to an outer surface of the upper interior wall transverse to a plane defined by the upper interior wall to provide lateral bracing support for the concrete poured into the channel.

4. The form assembly of claim 3, wherein an interior space of the channel is defined by an upper interior wall of the upper barrier of the second barrier assembly, a lower interior wall of the lower barrier of the second barrier assembly, and the inner surface of the first barrier assembly.

5. The form assembly of claim 4, further comprising an offset adapter assembly being releasably attached to the upper interior wall to provide a planar surface facing the channel.

6. The form assembly of claim 3, wherein the vertical guide is defined by a stepped edge disposed near a lower inner corner edge of the at least one upper side plate, and the outer surface of the upper interior wall.

7. The form assembly of claim 3, wherein at least one lower side plate is attached transversely to an outer surface of the lower interior wall to support the concrete in the channel.

8. The form assembly of claim 3, wherein the height adjustment assembly includes a lower member secured to the lower barrier, an upper member secured to the upper barrier, and a jackscrew mechanism interconnecting the lower and upper members, both lower and upper members including an elongated body and a central opening dimensioned to facilitate a telescoping operation of the lower and upper members.

9. The form assembly of claim 8, wherein an inner diameter of the upper member is greater than an outer diameter of the lower member, such that the upper member telescopes in a direction of a longitudinal axis of the lower member.

10. The form assembly of claim 8, wherein the lower member is attached at one end to a bottom plate of the lower barrier, and at an opposite end to a threaded connector sized to slidingly fit inside of the upper member.

11. The form assembly of claim 8, wherein an upper end of the upper member is attached to a spacer sleeve having a central opening configured and dimensioned to slidingly receive a threaded rod of the jackscrew mechanism.

12. The form assembly of claim 8 wherein an outer surface of the upper member is attached to an outer surface of an upper interior wall of the upper barrier in a direction of a longitudinal axis of the upper member.

13. The form assembly of claim 8, wherein a threaded rod of the jackscrew mechanism is mechanically connected at one end to a turn knob of the jackscrew mechanism, and at an opposite end is threadingly connected to a threaded connector fixedly attached to the lower member.

14. The form assembly of claim 8, wherein the jackscrew mechanism of the height adjustment assembly includes a coupler collar having a central opening dimensioned at one end to slidingly receive a turn knob, and at an opposite end slidingly receive a threaded rod, and wherein the turn knob is mechanically connected to the coupler collar and the coupler collar is mechanically connected to the threaded rod such that the turn knob and the threaded rod are mechanically affixed together to co-rotate.

15. The form assembly of claim 8, wherein the jackscrew mechanism is at least partially enclosed by a view box to allow access to parts associated with the jackscrew mechanism.

16. The form assembly of claim 8, wherein at least one thrust bearing is provided between the jackscrew mechanism and the upper barrier to support an axial load of the upper barrier, and preventing excessive wear and tear of associated parts of the jackscrew mechanism.

17. The form assembly of claim 8, wherein the jackscrew mechanism includes a protective mechanism to protect associated parts of the jackscrew mechanism during operation.

18. The form assembly of claim 8, wherein a turn knob of the jackscrew mechanism is inserted into a bore of a top plate of the upper barrier, and removably connected to the threaded rod being threadably connected to a threaded connector of the jackscrew mechanism, and wherein the turn knob is mechanically connected to the upper member and the threaded connector is fixedly attached to the lower member, such that the upper member telescopes relative to the lower member in a direction of a longitudinal axis of the lower member when the turn knob is rotated.

* * * * *